United States Patent [19]

Tominaga

[11] Patent Number: 4,941,867

[45] Date of Patent: Jul. 17, 1990

[54] CONTAINER ROTOR FOR A CENTRIFUGAL SEPARATOR

[75] Inventor: Kenji Tominaga, Tokyo, Japan

[73] Assignee: Tomy Seiko Co., Ltd., Tokyo, Japan

[21] Appl. No.: 389,488

[22] Filed: Aug. 4, 1989

[51] Int. Cl.[5] ..... B04B 5/02

[52] U.S. Cl. ..... 494/16; 494/20

[58] Field of Search ..... 494/16, 20, 17, 18, 494/19; 422/72; 366/208, 209, 213, 214

[56] References Cited

U.S. PATENT DOCUMENTS

| | | | |
|---|---|---|---|
| 3,762,635 | 10/1973 | Hankey | 494/16 |
| 4,427,406 | 1/1984 | Nielsen | 494/16 |
| 4,659,324 | 4/1987 | Sutton | 494/20 |
| 4,822,331 | 4/1989 | Taylor | 494/16 |

*Primary Examiner*—Robert W. Jenkins

*Attorney, Agent, or Firm*—Sherman Levy

[57] ABSTRACT

The present invention is to provide an improved container rotor for use in a centrifugal separator which can serve different types of the centrifugal separating operation by the employment of a specific rotor which allows three types of bucket to be exchanged readily with one out of the swing type, the angled aperture type and the horizontal aperture type accordingly to the kind of specimen to be separated, which comprises, in combination, a rotor body and a plurality of buckets, wherein the rotor body includes receiving recesses and an opposed pair of supports for receiving operatively the plurality of buckets, the buckets being adapted to afford three different types of centrifugal separating operations, i.e., the swing type, the angled aperture type and the horizontal aperture type.

1 Claim, 9 Drawing Sheets

CONTAINER ROTOR FOR A CENTRIFUGAL SEPARATOR

FIELD OF THE INVENTION AND RELATED ART STATEMENT

The present invention relates in general to a centrifugal separator, and more particularly to a rotor element for use in a centrifugal separator.

Conventionally, centrifugal separators have been commonly in use for physically separating under the effect of centrifugal forces sample material or other stock placed therein for varied tests and analyses to follow in the fields of medical or other industries. Material and stock to be subjected to such physical separating operations may vary so extensively.

In this connection, there have been adopted a variety of types of rotor mechanisms for use in this centrifugal separation operation such as of a swing type rotor, an angled aperture type rotor, a horizontal aperture type rotor, etc., which may vary in its adaptability and so prove its merits in accordance with the type of specimen to be separated, particularly in view of the divergence in specimen's viscosity.

Taking as an example a swing type rotor mechanism, as shown in FIG. 8 (*a*) and (*b*), there is shown provided a rotor assembly 102 which is mounted rotatably about a central rotating shaft 101, and which is adapted to receive swingably a plurality of, or four in this illustrative construction, buckets 103 on its cross-shaped support. In this example, it is seen that one of the swingably supported bucket 103 is defined with a plurality of, or four in this example, openings or apertures 104, which are adapted to snugly receive storage tubes 105 containing specimen therein. With such arrangement, when the rotor assembly 102 is caused to be rorated about its central shaft 101 during the separation operation, the buckets 103 are forced to swing radially outwardly under the effect of centrifugal force rendered thereupon while in rotation, as schematically shown by a double-headed arrow in FIG. 8 (*b*).

This swing type rotor is known advantageous in that it may exhibit a least disturbance in the spin-separated specimen from the effect of gravity, and or this reason, this is an idealistic performance as attained from the rotor for use in a centrifugal separator. Despite this particular advantage, however, it cannot be relieved from such an inherent problem that it has a substantially smaller capacity of separation than other rotor design, especially than the horizontal aperture type rotor.

Now, referring to the angled type rotor for use in a centrifugal separator, with its general construction shown in FIGS. 9 (*a*) and (*b*), it is seen constructed that this type rotor is defined with a plurality of recesses 108 in its rotor element 107 extending diagonally downwardly, into each of which recesses there are inserted a specimen storage tube 109.

It is known in practice that the angled aperture type rotor may exhibit a performance of moderate grade between the swing type rotor noted above and the horizontal aperture type rotor.

Referring next to the horizontal aperture type rotor construction, as typically shown in FIGS. 10 (*a*) and (*b*), there is shown provided a central rotor assembly 111, which is mounted rotatably about a rotating shaft 110, and into which a plurality of, or four in this example, buckets 113 with a plurality of openings or apertures 112 being defined horizontally or radially of the rotating shaft 110 are placed in position, and into each of which apertures there is inserted a specimen storage tube 114 in position for centrifugal separating operations.

With the construction of this horizontal aperture type rotor, and when this type rotor is used for a specimen with a relatively high viscosity, there is observed no tangible disturbance of specimen's separation by the influence of gravity after the operation of centrifugal separation, and in this consideration, it may well serve as a rotor element for the centrifugal separator, which has a sufficiently large capacity permitting the use of a relatively great number of storage tubes, and which may then serve separation of such a dense mass as jelly or like specimen.

However, the swing type rotor, the angle aperture type rotor and the horizontal aperture type rotor mentioned above are commonly constructed to be a built-in element for the centrifugal separator which is subject to choice in accordance with its object of use, and therefore, when it is desired to exchange some of such rotors of different constructions accordingly with the kind of specimen to be separated by centrifugal operations, it would then take considerable time and trouble in its exchange job, which would naturally result in an inefficient working property.

In addition, the provision of such a variety of rotors which are to be manufactured and supplied from different sources would undoubtedly turn to be uneconomical in view of production cost and resources, respectively.

OBJECT AND SUMMARY OF THE INVENTION

In consideration of such drawbacks which have been left unattended in the prior art, it would be desirable to attain an efficient solution therefor. In this respect, the present invention is essentially directed, in an attempt to the resolution of such inconviences which have been encountered in the prior art as reviewed above, to the provision of an improvement in and relating to a container rotor for use in a centrifugal separating apparatus which can be adapted readily to convert to be of any of the swing type, the angled aperture type and of the horizontal aperture type simply by the replacement of specific buckets adaptable to such uses to be mounted onto the rotor of a centrifugal separator.

The present invention provides, in order to attain this object, an improved container rotor adapted to be mounted onto the output shaft of a driving motor for a centrifugal separator and hold a plurality of storage tubes containing specimen therein in position for the centrifugal separating operation, which comprises, in combination, as summarized in brief, a rotor body means and a plurality of bucket means;

the rotor body means being of a cylindrical shape with a closed bottom and including a mount for receiving said output shaft of the driving motor in the bottom center thereof, the rotor body means having further receiving recess means for receiving operatively the plurality of bucket means in the circumference of the rotor body means disposed at an equal interval around the central mount, the recess means being defined with an opposed pair of support means in the side wall sections thereof; the plurality of bucket means being of three different types, wherein one of the bucket means is of the type having a plurality of openings or apertures defined extending in the vertical direction when installed in operative position and at an equal interval from each other for receiving specimen containing tube means therein, and having an opposed pair of trunnion means extending outwardly from the opposite side wall portion thereof so that the bucket means may be held swingably by the support means defined in the side wall sections of the recess means;

another of the bucket means is of the type having a plurality of openings or apertures defined extending diagonally downwardly as viewed when installed in operative position of the recess means and at an equal interval from each other for receiving specimen containing tube means therein, and adapted to be received in securely held position in the recess means; and still another of the bucket means is of the type having a plurality of openings or apertures defined extending horizontally as viewed when installed in operative position of the recess means and at an equal interval from each other for receiving specimen containing tube means therein, and adapted to be received in securely held position in the recess means.

As is apparent to those skilled in the art from the statement above, according to the advantageous construction of a container rotor for use in a centrifugal separating apparatus, there is provided an improved rotor construction which comprises a rotor assembly and a plurality of buckets to be mounted operatively into the rotor assembly, which buckets are provided in three different types as noted above. With the provision of such a variety of bucket designs which can be exchanged readily when desired, there can be attained such an advantageous effect that any of such variable buckets of the swing type, the angled aperture type and of the horizontal aperture type may be adopted for replacement with others that are required for use in accordance with the kind of specimen to be separated by centrifugal separating operation, and that this job of exchange can be made readily in a short period of time, which may together contribute to an efficient working property, accordingly.

In addition, according to this advantageous aspect of the present invention, the rotor element can of course be adapted for common use regardlessly of which type of rotor may be adopted in use for any one of the centrifugal separating operations by way of the swing type, the angled aperture type or of the horizontal aperture type, which may naturally contribute to a substantial reduction in production cost of the entire apparatus.

These and other objects and advantages of the invention can be understood better from, when read, the following detailed description by way of a preferred embodiment of a container rotor for use in a centrifugal separator improved in accordance with the present invention as described with reference to the accompanying drawings. In the detailed description of the present invention to follow, reference is made to the accompanying drawings, in which like parts are designated by like reference numerals.

BRIEF DESCRIPTION OF THE DRAWINGS

FIGS. 1 through 7 are presented to show a preferred embodiment of the present invention; in which FIG. 1 is a general view showing, in cross section, the construction of an entire centrifugal separator;

FIG. 2 is a perspective view showing an entire rotor assembly;

FIGS. 3 (*a*), (*b*) and (*c*) are general perspective view s showing each of the general constructions of three types of buckets to be mounted for use into the rotor assembly;

FIGS. 4 (*a*) and (*b*) are a plan view and a semi-cross sectional view showing the rotor assembly, respectively;

FIGS. 5 (*a*) and (*b*) are a plan view and a semi-cross sectional view showing a swing type rotor, when assembled, respectively;

FIGS. 6 (*a*) and (*b*) are a plan view and a semi-cross sectional view showing a angled aperture type rotor, respectively;

FIGS. 7 (*a*) and (*b*) are a plan view and a semi-cross sectional view showing a horizontal aperture type rotor, respectively;

DETAILED DESCRIPTION OF PREFERRED EMBODIMENTS

In the following, the present invention will now be described in greater detail by way of a preferred embodiment shown in the accompanying drawings.

Figure 1:
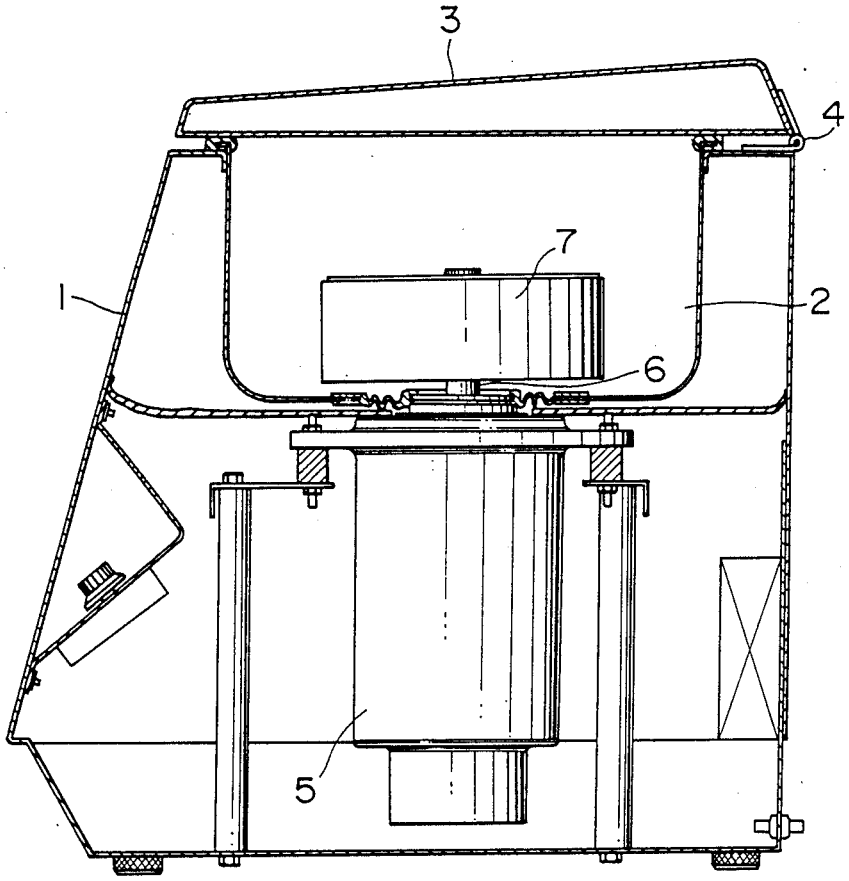

Firstly, FIG. 1 is presented to show the general construction of a typical conventional centrifugal separator, wherein an improved rotor according to the preferred embodiment of the present invention.

Referring to this drawing figure, there are shown provided a centrifugal separator casing designated at the reference number 1, and a rotor chamber at 2 disposed in the upper part of the casing 1. Also, seen is a top cover at 3 which is disposed to close the open top of the rotor chamber 2, which top cover 3 is hinged swingably to the separator casing 1 by way of a hinge 4.

In the lower central area of the separator casing 1, there is provided a driving motor 5 with its output shaft 6 extending upwardly into the rotor chamber 2. Upon the motor output shaft 6, there is mounted operatively a rotor assembly 7, which is to be described in detail later.

Figure 2:
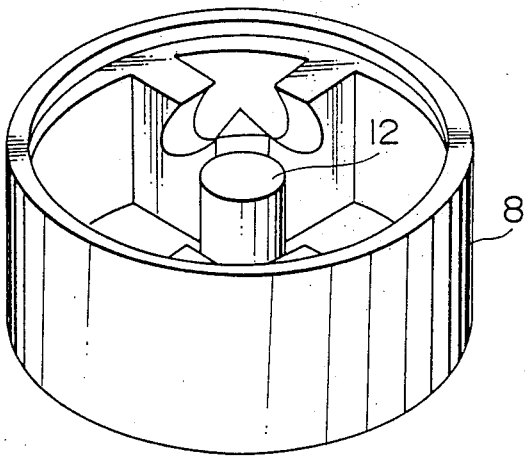
Figure 3A:
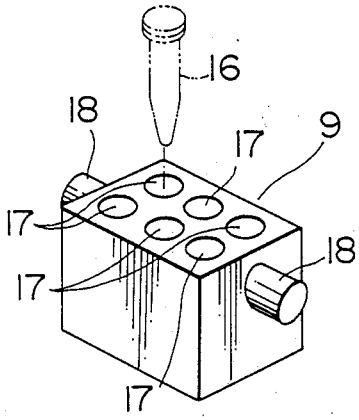
Figure 3B:
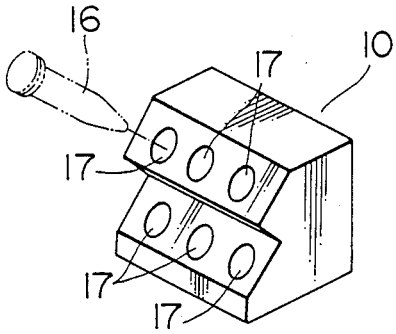
Figure 3C:
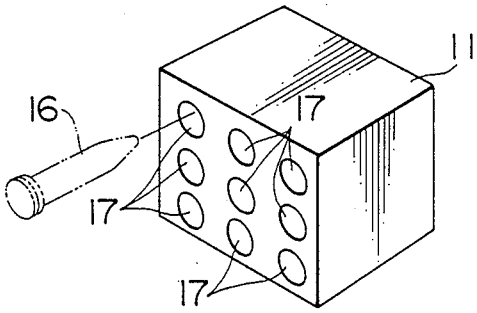

The rotor assembly 7 is, as typically shown in FIGS. 2 and 3, comprised of a rotor body 8 and a set of buckets, each including three types of bucket element 9, 10, 11.

Figure 4A:
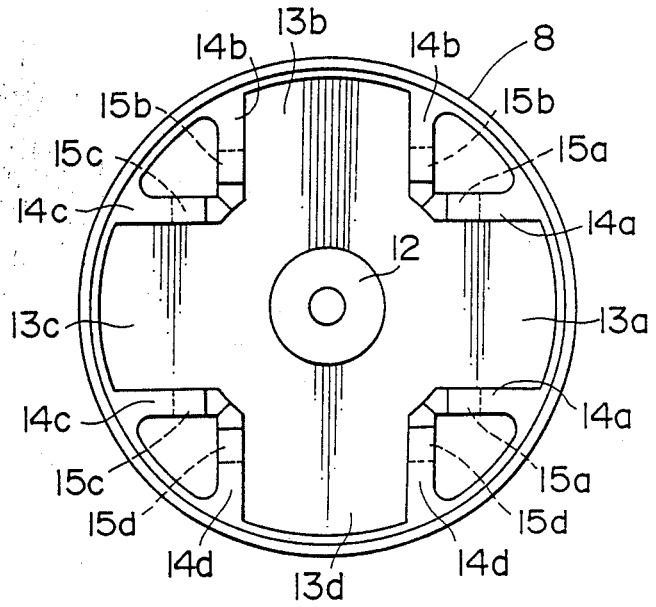
Figure 4B:
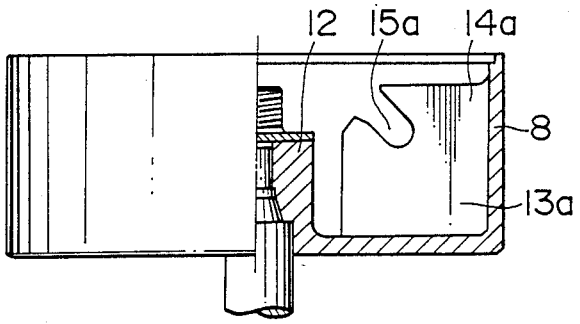

The rotor body 8 is of a cylindrical shape with a closed bottom having, as shown in FIGS. 4 (*a*) and (*b*), a plan view and a semi-cross sectional view, a mount 12 for receiving the output shaft 6 of the driving motor disposed in bottom center thereof, and also four bucket receiving sections 13*a*, 13*b*, 13*c* and 13*d* defined around the motor output shaft mount 12. In the side wall sections 14*a*, 14*b*, 14*c* and 14*d* which define the bucket receiving sections 13*a*, 13*b*, 13*c* and 13*d* therebetween, there are shown defined elongated grooves 15*a*, 15*b*, 15*c* and 15*d* extending diagonally downwardly for supporting the bucket 9 to be described later.

It is designed that any one set of buckets comprising three different types of bucket element 9, 10 and 11 can be mounted operatively into this rotor body 8 in accordance with the kind of specimen to be subject to the centrifugal separating operation.

As shown in FIG. 3 (*a*), one type of the bucket elements is of a rectangular parallelopiped shape defined with a plurality of openings or apertures 17 extending in the vertical direction for holding specimen containing storage tubes in upright position, and with a pair of trunnions 18 extending opposedly on its opposite side walls to be received rotatably by the diagonal grooves 15 defined in the wide walls noted above.

Figure 5A:
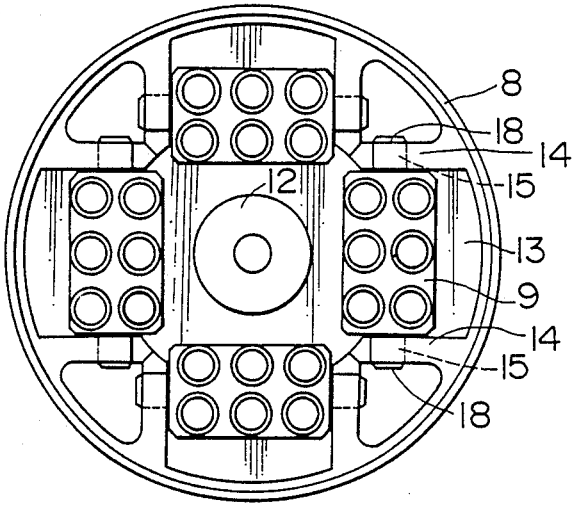
Figure 5B:
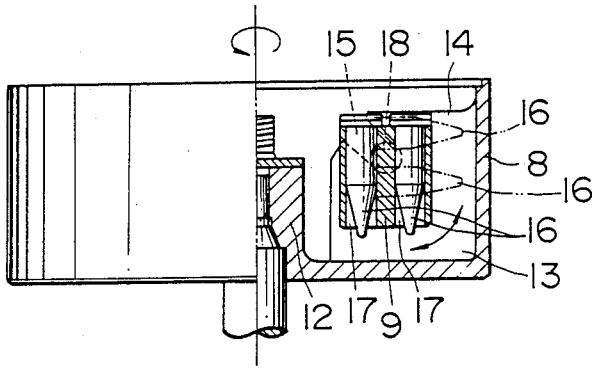

This type bucket element 9 is, as typically shown in FIGS. 5 (*a*) and (*b*), held swingably in position at its trunnions 18 on the opposed side walls by the corresponding grooves 15 defined in the receiving section 13 of the rotor body 8.

With the bucket elements 9 being held in operative position of the rotor assembly 7, when the centrifugal separator is driven in rotation, the bucket elements 9 are forced to be swinged radially outwardly or horizontally as shown by an arrow in FIG. 5 (*b*) under the effect of centrifugal force rendering thereupon, and the specimen contained in the storage tubes which are held by the rotor assembly is separated accordingly to the mass of its components in the state as indicated by a virtual line. When the rotor assembly 7 is stopped in rotating motion, the bucket elements 9 return to their original vertical position, and this state of separation of the specimen would no longer be disturbed by the effect of gravity. This type rotor may serve properly in the centrifugal separating operation of a specimen with a relatively small viscosity.

Another type of bucket is of an irregular shape comprised of a plurality of polygon as shown perspectively in FIG. 3 (*b*), in which there are defined a plurality of openings or apertures 17 which extend diagonally downwardly to receive storage tubes containing specimen therein.

Figure 6A:
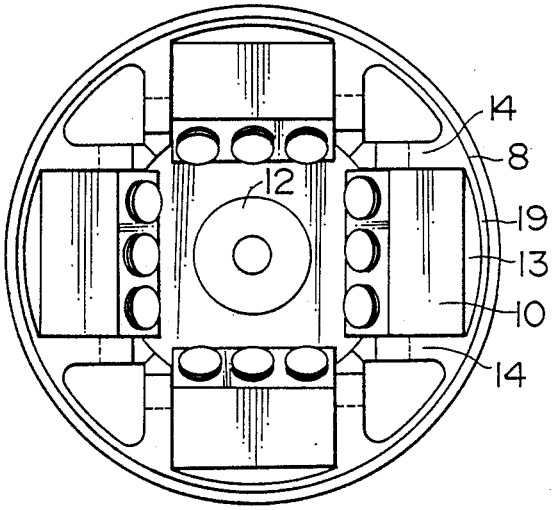
Figure 6B:
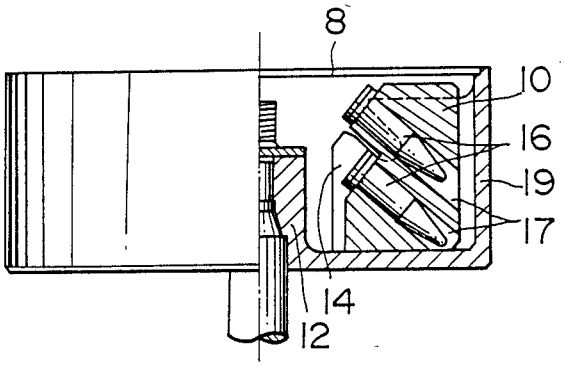
Figure 7A:
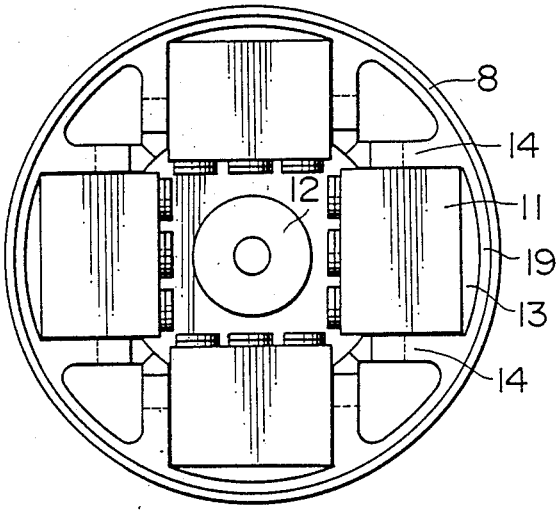
Figure 7B:
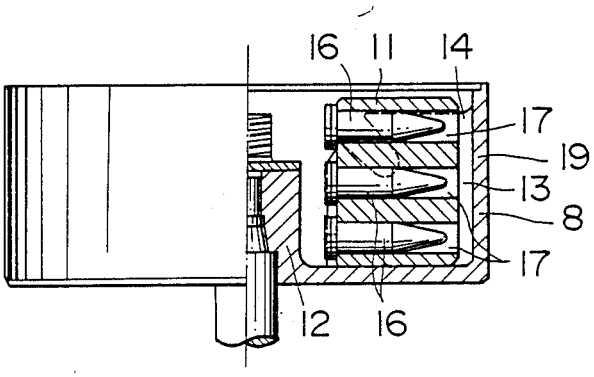
Figure 8A:
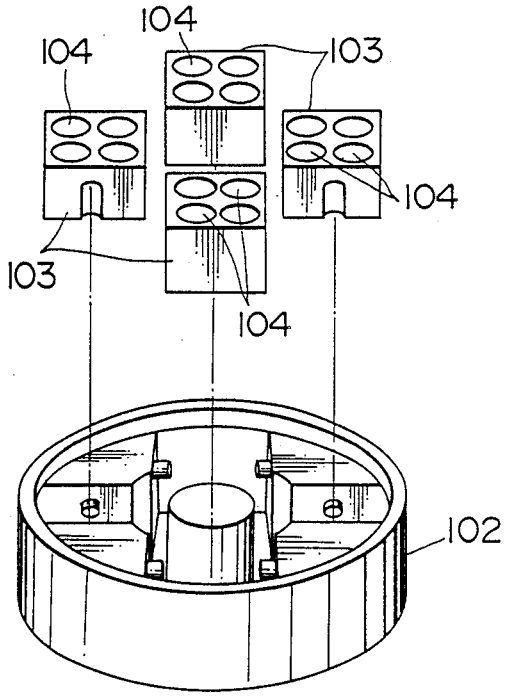
FIG. 8(a) (PRIOR ART)
FIGS. 8 (*a*) and (*b*), FIGS. 10 (*a*) and (*b*) are presented to show a typical construction of the conventional centrifugal separator; in which FIGS. 8 (*a*) and (*b*) are a perspective exploded view and a semi-cross sectional view showing a swing type rotor; a piston guide, when mounted yet not in a work position.
Figure 8B:
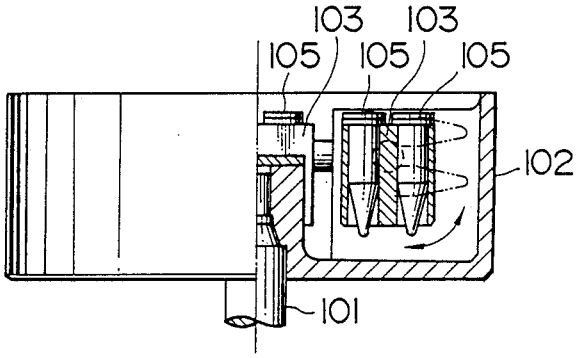
FIG. 8(b) (PRIOR ART)
Figure 9A:
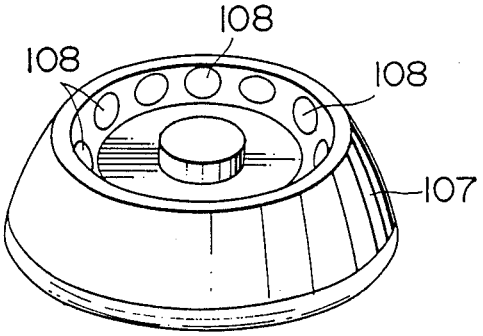
FIG. 9(a) (PRIOR ART)
FIGS. 9 (*a*) and (*b*) are a perspective view and a semi-cross sectional view showing an angled aperture type rotor.
Figure 9B:
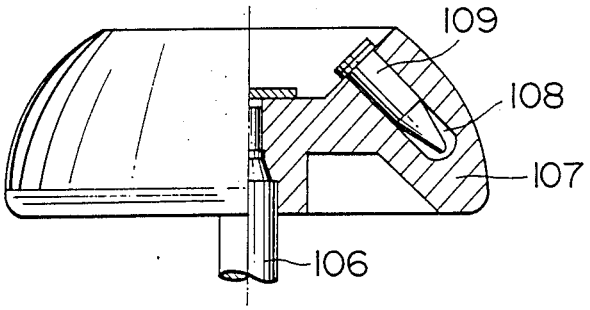
FIG. 9(b) (PRIOR ART)
Figure 10A:
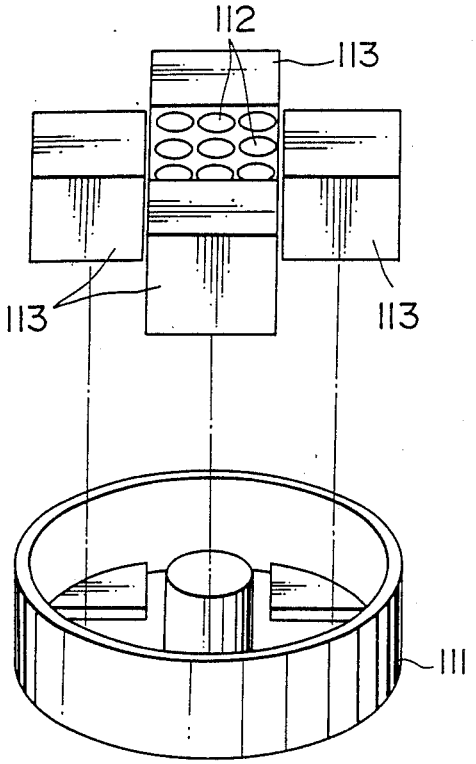
FIG. 10(a) (PRIOR ART)
FIGS. 10 (*a*) and (*b*) are a perspective view and a semi-cross sectional view showing a horizontal aperture type rotor.
Figure 10B:
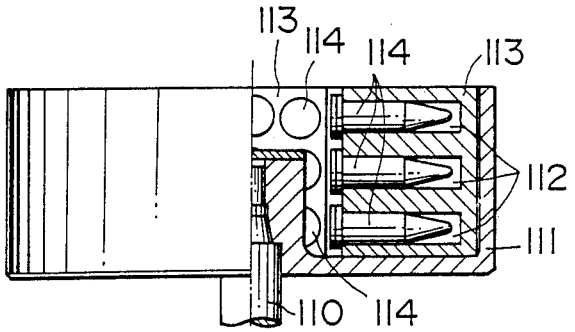
FIG. 10(b) (PRIOR ART)

With this construction, this type bucket element 10 are placed securely in operative position within the receiving section 13 of the rotor body 8 abutting against the side walls 14 and the circumferential wall 19 of the rotor body 8 in which the storage tubes containing specimen therein may be placed with a certain angle with respect to the plane of rotating motion of the rotor assembly 7, as shown generally in FIGS. 6 (*a*) and (*b*), respectively.

With this type of bucket element 10 installed in position, the rotor assembly 7 may serve as the so-called angled aperture type rotor, accordingly.

As for the horizontal aperture type rotor, there is provided the one as shown in FIG. 3 (*c*) wherein it is of a rectangular parallelopiped defined with a plurality of openings or apertures 17 extending in the horizontal direction as viewed in the figure for receiving storage tubes 16 containing specimen therein, which is adapted to be placed in an fixed relationship with the receiving section 13 of the rotor body 8 abutting against the side walls 14 and the circumferential wall 19 thereof when installed in operative position.

The rotor assembly 7 with the buckets of horizontal aperture type 11 being installed in this operative position may serve a relatively large storage capacity in the rotor body 8 for the receipt of storage tubes containing specimen therein 16 in comparison with the other types of bucket 9 and the 10 noted above. This is because there are required substantial dead spaces for receiving these types of bucket 9 and 10, since the former needs an additional space allowing the swinging motion thereof when operated for a centrifugal separating operation, and since the latter would occupy more space with its irregular polygonal shape leaving a vacant space of triangular shape in the upper and lower positions when installed in the receiving section 13. For this reason, the swing type rotor 9 and the angled aperture type rotor 10 would then turn to be smaller in volume, thus having the number of apertures 17 for the receipt of specimen containing storage tubes 16 reduced accordingly. In this respect, therefore, the horizontal aperture type rotor 11 may advantageously afford an efficient use of limited space in the interior of the rotor body 8, which means the provision of a greater capacity in the centrifugal separating operation than the other types of buckets.

As is apparent to those skilled in the art, the improvement in the container rotor for use in the centrifugal separator according to the present invention may efficiently bring the versatility in separating operations from the readiness in exchange of the three types of container rotor, namely, the swing type rotor 9, the angled aperture type rotor 10 and the horizontal aperture type rotor 11, which is advantageously allowed with the improvement in the construction of the rotor body 8. With this advantageous arrangement according to the present invention, any of such different types of container rotor can be exchanged for the other readily accordingly to the type of specimen to be separated in the centrifugal separation, and consequently, there is attainable a substantial advantage with respect to the working properties as well as the economy in the centrifugal separating operations from this advantageous versatility of the invention as reviewed fully hereinbefore.

While the present invention has been described herein by way of the specific embodiment thereof, it is to be understood that the present invention should not be restricted to the detailsd of such embodiment noted above, but that many other variations and modifications may be attained on the basis of the technical concept of the invention.

For instance, while there are provided four bucket receiving sections 13*a*, 13*b*, 13*c* and 13*d* in the interior of the rotor body 8 in the preferred embodiment of the invention, it is of course possible iin practice to employ any number of receiving sections as desired, which would render no affection in the effect and function of the invention, at all.

In addition, while it was stated by way of a preferred embodiment of the invention that one and the same type of buckets are adopted at a time in the operative position of the rotor body 8, it is to be noted possible that different types of specimen may be separated with the use of different types of buckets at once installed in operative position of the rotor body 8, selecting a right type of bucket for a desired type of specimen accordingly.

In closing, it is also to be understood that the appended claims are intended to cover all of such generic and specific features as are particular to the invention as disclosed herein and all statements relating to the scope of the invention, which might as a matter of language be taken to fall thereunder.

I claim:

1. A container rotor adapted to be mounted onto the output shaft of a driving motor for a centrifugal separator for holding a plurality of storage tubes containing specimen therein in position for centrifugal separating operation, comprising, in combination;

a rotor body means and a plurality of bucket means;

said rotor body means being of a cylindrical shape with a closed bottom and including a mount for receiving said output shaft of the driving motor in the bottom center thereof, said rotor body means having further receiving recess means for receiving operatively said plurality of bucket means in the circumference of said rotor body means disposed at an equal interval around said mount, said recess means being defined with an opposed pair of support means in the side wall sections thereof;

said plurality of bucket means being of three different types, wherein one of said bucket means is of the type having a plurality of openings or apertures defined extending in the vertical direction when installed in operative position and at an equal interval from each other for receiving specimen containing tube means therein, and having an opposed pair of trunnion means extending outwardly from the opposite side wall portion thereof so that said bucket means may be held swingably by said support means defined in the side wall sections of said recess means;

another of said bucket means is of the type having a plurality of openings or apertures defined extending diagonally downwardly as viewed when installed in operative position of said recess means and at an equal interval from each other for receiving specimen containing tube means therein, and adapted to be received in securely held position in said recess means; and still another of said bucket means is of the type having a plurality of openings or apertures defined extending horizontally as viewed when installed in operative position of said recess means and at an equal interval from each other for receiving specimen containing tube means therein, and adapted to be received in securely held position in said recess means.

* * * * *